US007490372B2

(12) United States Patent
Huang

(10) Patent No.: US 7,490,372 B2
(45) Date of Patent: Feb. 17, 2009

(54) WALL-INSERT TYPE SHOWER HEAD

(76) Inventor: Shu Zhu Huang, 4F., No. 11, Alley 9, Lane 274, Shusiao Rd., Taiping City Taichung County (TW) 411

( * ) Notice: Subject to any disclaimer, the term of this patent is extended or adjusted under 35 U.S.C. 154(b) by 679 days.

(21) Appl. No.: 11/177,104

(22) Filed: Jul. 7, 2005

(65) Prior Publication Data

US 2007/0006380 A1 Jan. 11, 2007

(51) Int. Cl.
*A47K 3/28* (2006.01)

(52) U.S. Cl. ..... 4/615; 4/695; 285/46; 285/383; 285/402

(58) Field of Classification Search ..... 4/615, 4/678, 695; 285/46, 137.11, 193, 361, 383, 285/396, 402; 137/359, 360
See application file for complete search history.

(56) References Cited

U.S. PATENT DOCUMENTS 2,165,163 A * 7/1939 Waters ..... 285/361 X
2,582,338 A * 1/1952 Mansfield ..... 210/266
6,378,912 B1 * 4/2002 Condon et al. ..... 4/615 X

* cited by examiner

*Primary Examiner*—Robert M Fetsuga
(74) *Attorney, Agent, or Firm*—Banger Shia

(57) ABSTRACT

A shower head includes an adapter, an extension pipe, a cover, and a filter. Thus, the locking blocks of the extension pipe are locked in and unlocked from the locking slots of the adapter by rotation of the extension pipe, so that the extension pipe is mounted on and detached from the adapter easily and rapidly, thereby facilitating a user mounting and detaching the shower head.

14 Claims, 7 Drawing Sheets

WALL-INSERT TYPE SHOWER HEAD

BACKGROUND OF THE INVENTION

1. Field of the Invention

The present invention relates to a shower head, and more particularly to a wall-insert type shower head.

2. Description of the Related Art

A conventional shower head in accordance with the prior art shown in FIG. 10 comprises an extension pipe 90 having a first end screwed into a water supply pipe 85 mounted in a wall 80 and a second end provided with a nozzle 95. However, the extension pipe 90 is secured to the wall 80, so that the extension pipe 90 cannot be detached from the wall 80 easily, thereby causing inconvenience to a user when he wishes to detach the extension pipe 90 from the wall 80 for maintenance of the shower head.

SUMMARY OF THE INVENTION

The present invention is to mitigate and/or obviate the disadvantage of the conventional shower head.

The primary objective of the present invention is to provide a shower head that is mounted on the wall easily and rapidly, thereby facilitating a user mounting the shower head.

Another objective of the present invention is to provide a shower head, wherein the locking blocks of the extension pipe are locked in and unlocked from the locking slots of the adapter by rotation of the extension pipe, so that the extension pipe is mounted on and detached from the adapter easily and rapidly, thereby facilitating a user mounting and detaching the extension pipe for replacement of the filter cartridge.

A further objective of the present invention is to provide a shower head, wherein the cover has an end face rested on the wall, thereby enhancing the aesthetic quality of the shower head.

A further objective of the present invention is to provide a shower head, wherein the water is divided by the water dividing channels of the second end cap so that the water is injected outward from the water outlet hole of the water outlet port evenly and smoothly, thereby providing a massaging effect to a user.

In accordance with the present invention, there is provided a shower head, comprising an adapter having an inner peripheral wall formed with a plurality of substantially inverted L-shaped locking slots, and an extension pipe having a first end detachably locked in the adapter and having an outer peripheral wall formed with a plurality of substantially L-shaped locking blocks each detachably locked in a respective one of the locking slots of the adapter by rotation of the extension pipe.

Further benefits and advantages of the present invention will become apparent after a careful reading of the detailed description with appropriate reference to the accompanying drawings.

DETAILED DESCRIPTION OF THE INVENTION

Figure 1:
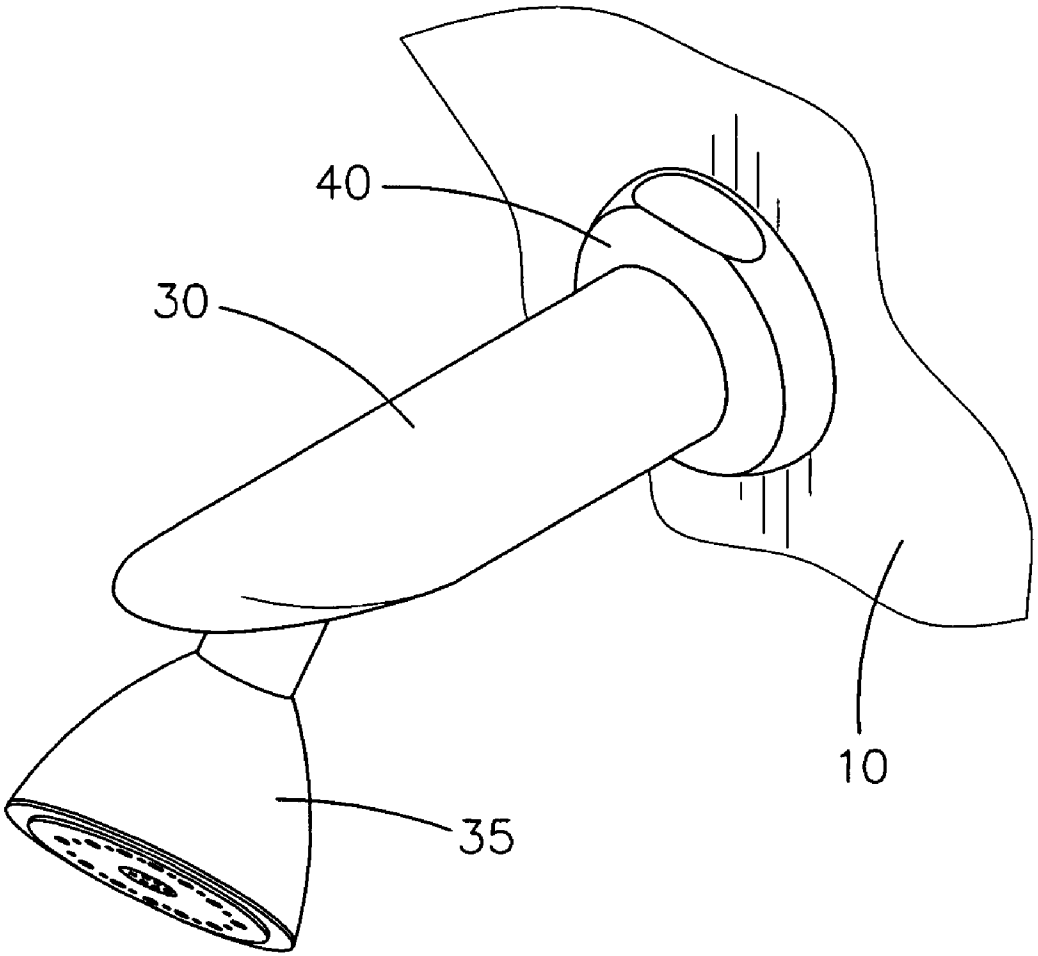
FIG. 1 is a perspective view of a shower head in accordance with the preferred embodiment of the present invention.
Figures 2, 3:
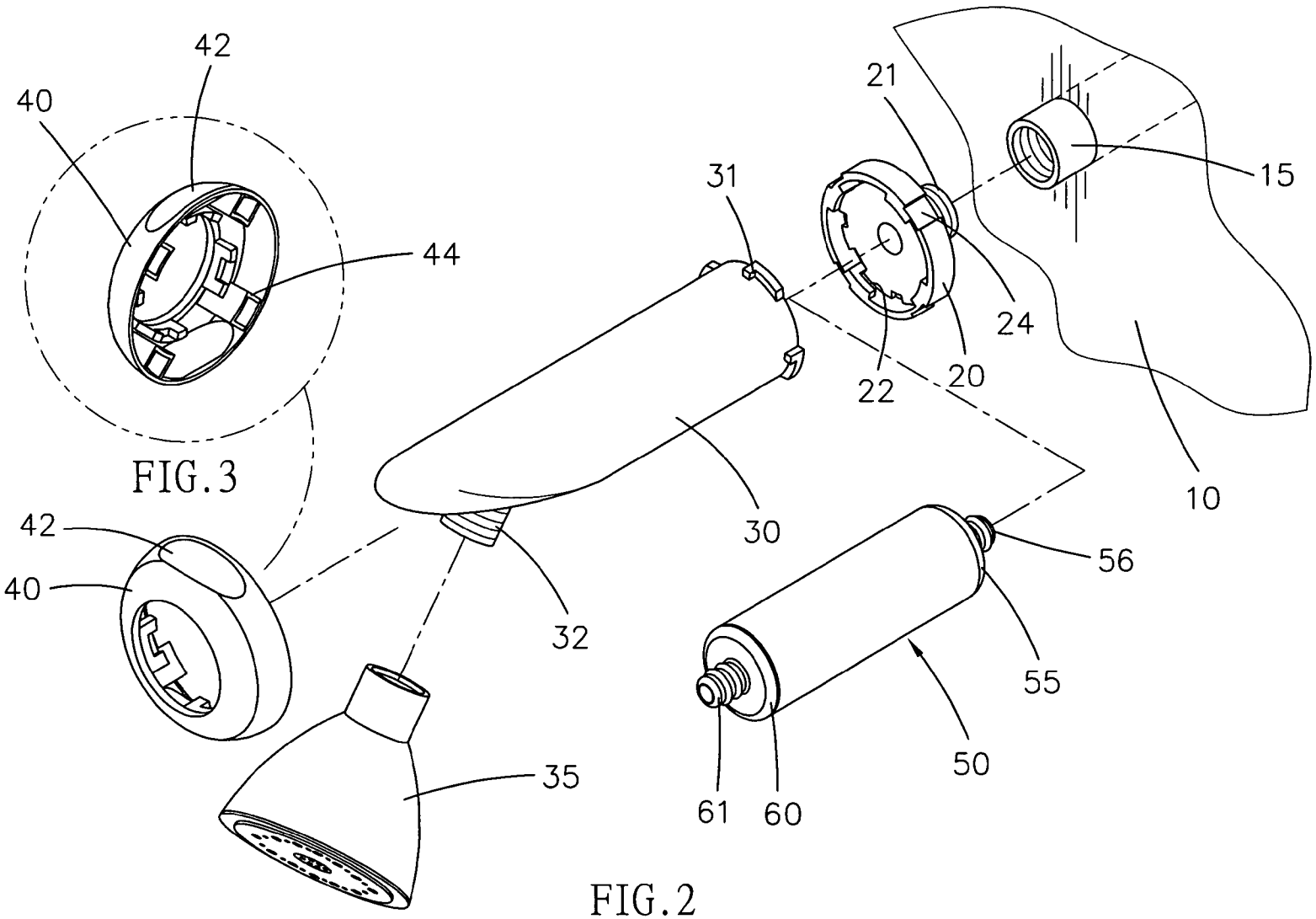
FIG. 2 is an exploded perspective view of the shower head as shown in FIG. 1.
FIG. 3 is a perspective view of a cover of the shower head as shown in FIG. 2.
Figure 4:
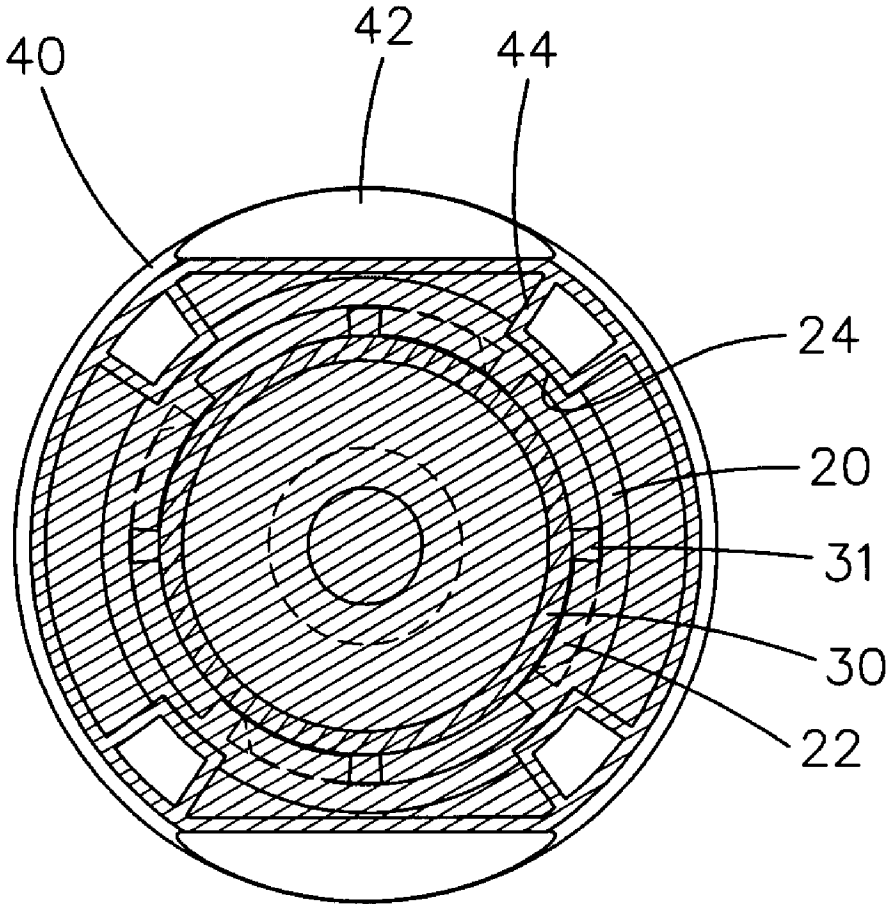
FIG. 4 is a plan cross-sectional view of the shower head as shown in FIG. 1.

Referring to the drawings and initially to FIGS. 1-4, a shower head in accordance with the preferred embodiment of the present invention comprises an adapter 20, an extension pipe 30, a cover 40, and a filter 50.

The adapter 20 is mounted on a wall 10 and connected to a water supply pipe 15 mounted in the wall 10. The adapter 20 has a substantially U-shaped cross-sectional profile and has a side provided with a protruding hollow threaded connector 21 screwed into the water supply pipe 15 to lock the adapter 20 to the water supply pipe 15 of the wall 10. The adapter 20 has an inner peripheral wall formed with a plurality of substantially inverted L-shaped locking slots 22 each having a tapered inner face. The locking slots 22 of the adapter 20 are equidistantly spaced from each other. The adapter 20 has an outer peripheral wall formed with a plurality of insertion recesses 24.

The extension pipe 30 has a first end detachably locked in the adapter 20 and having an outer peripheral wall formed with a plurality of substantially L-shaped locking blocks 31 each detachably locked in a respective one of the locking slots 22 of the adapter 20 by rotation of the extension pipe 30. The locking blocks 31 of the extension pipe 30 are equidistantly spaced from each other. Each of the locking blocks 31 of the extension pipe 30 has a tapered inner face urged on the tapered inner face of the respective locking slot 22 of the adapter 20, so that each of the locking blocks 31 of the extension pipe 30 is closely fitted in the respective locking slot 22 of the adapter 20. The extension pipe 30 has a second end provided with a protruding threaded connector 32 for mounting a nozzle 35.

The cover 40 is detachably locked on the adapter 20 and rested on the first end of the extension pipe 30. The cover 40 has a substantially U-shaped cross-sectional profile. The cover 40 has an inner peripheral wall formed with a plurality of insertion blocks 44 detachably inserted into a respective one of the insertion recesses 24 of the adapter 20 and an outer peripheral wall formed with a finger depression 42 to facilitate a user holding the cover 40. The cover 40 has a thickness greater than that of the adapter 20 so that the cover 40 has an end face rested on the wall 10 after the first end of the extension pipe 30 is locked in the adapter 20.

Figure 6:
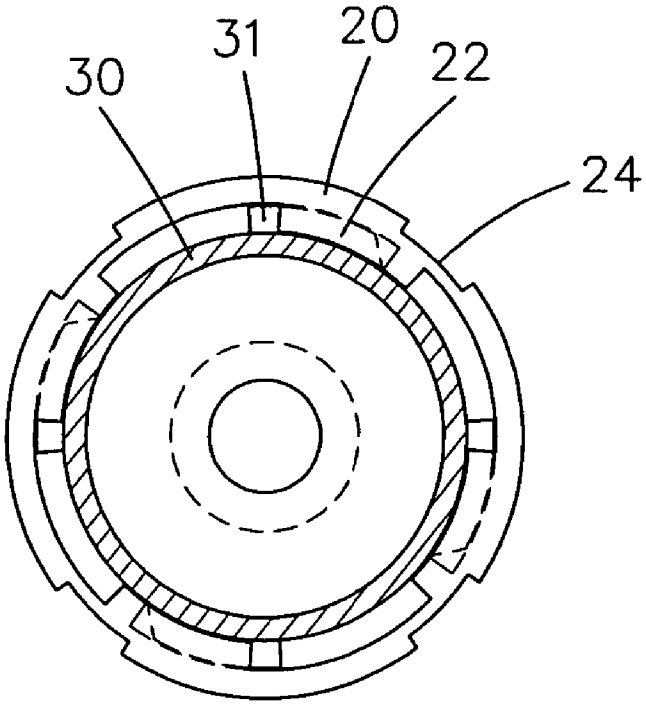
FIG. 6 is a schematic operational view of the shower head as shown in FIG. 5.
Figure 5:
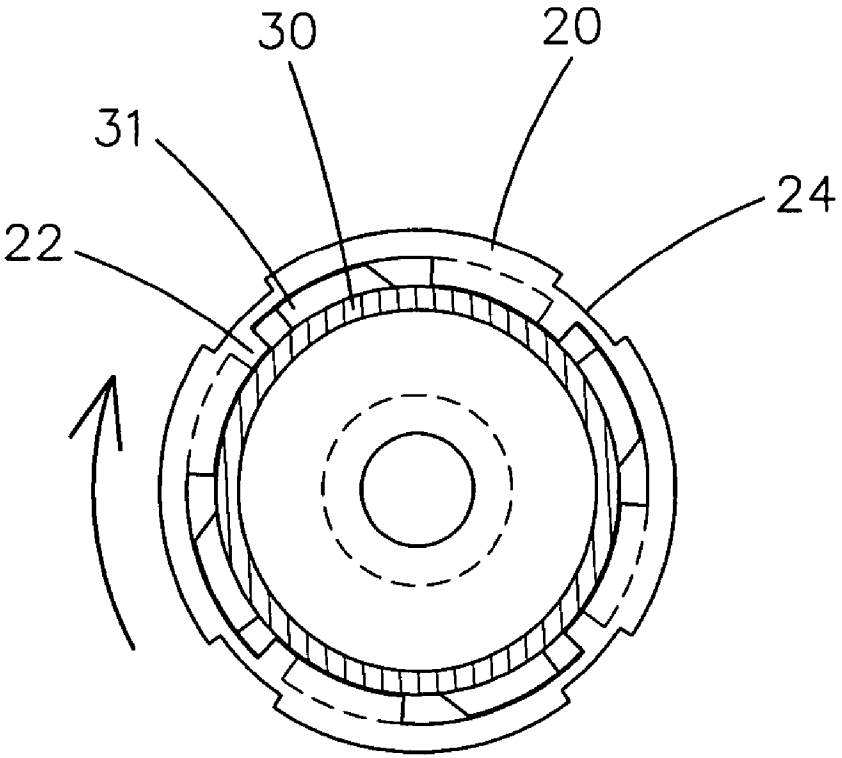
FIG. 5 is a plan cross-sectional view of the shower head as shown in FIG. 1.

As shown in FIGS. 5 and 6 with reference to FIGS. 1-4, the threaded connector 21 of the adapter 20 is screwed into the water supply pipe 15 to lock the adapter 20 to the water supply pipe 15 of the wall 10. Then, the cover 40 is mounted on the extension pipe 30. Then, the first end of the extension pipe 30 is inserted into the adapter 20. Then, the extension pipe 30 is rotated relative to the adapter 20, so that each of the locking blocks 31 of the extension pipe 30 is inserted into and locked in a respective one of the locking slots 22 of the adapter 20 by rotation of the extension pipe 30. At this time, each of the locking blocks 31 of the extension pipe 30 has a tapered inner face urged on the tapered inner face of the respective locking slot 22 of the adapter 20, so that each of the locking blocks 31 of the extension pipe 30 is closely fitted in the respective locking slot 22 of the adapter 20. Then, the cover 40 is movable relative to the adapter 20, so that the insertion blocks 44 of the cover 40 are inserted into the insertion recesses 24 of the adapter 20 to secure the cover 40 to the adapter 20. At this time, the cover 40 has an end face rested on the wall 10, thereby enhancing the aesthetic quality of the shower head.

Figures 7, 8:
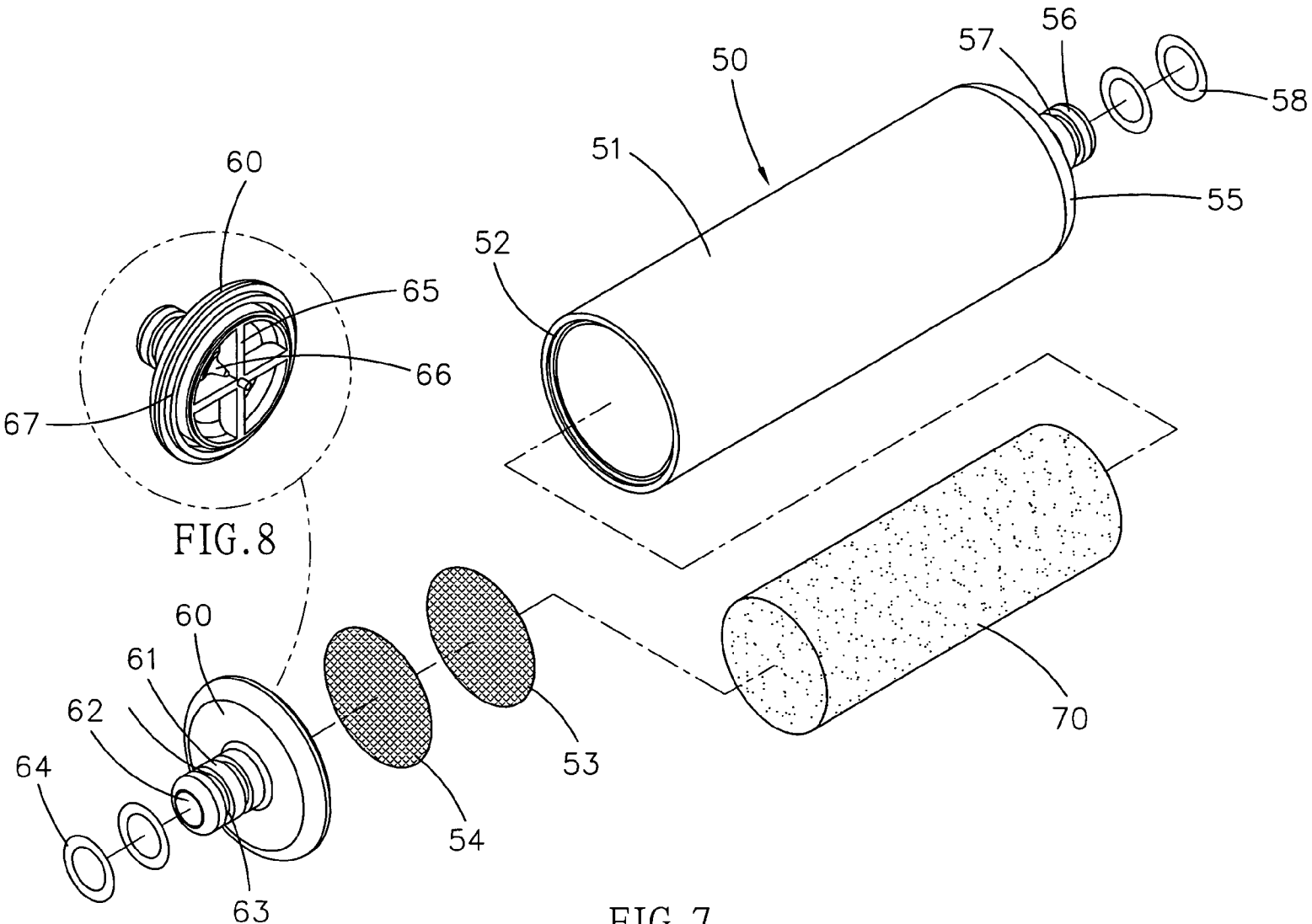
FIG. 7 is an exploded perspective view of a filter of the shower head as shown in FIG. 1.
FIG. 8 is a perspective view of a second end cap of the filter as shown in FIG. 7.
Figure 9:
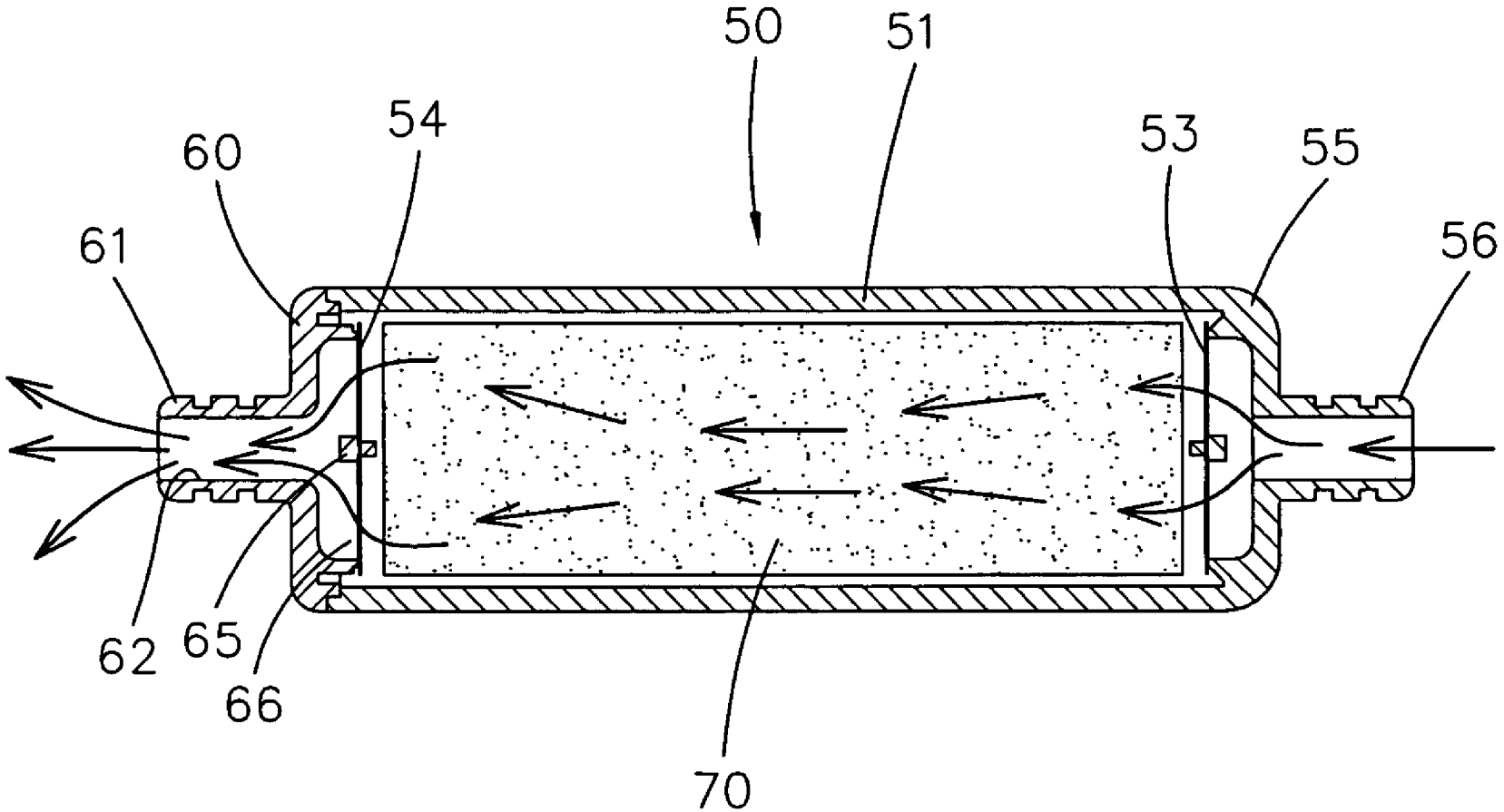
FIG. 9 is a plan cross-sectional assembly view of the filter as shown in FIG. 7.
Figure 10:
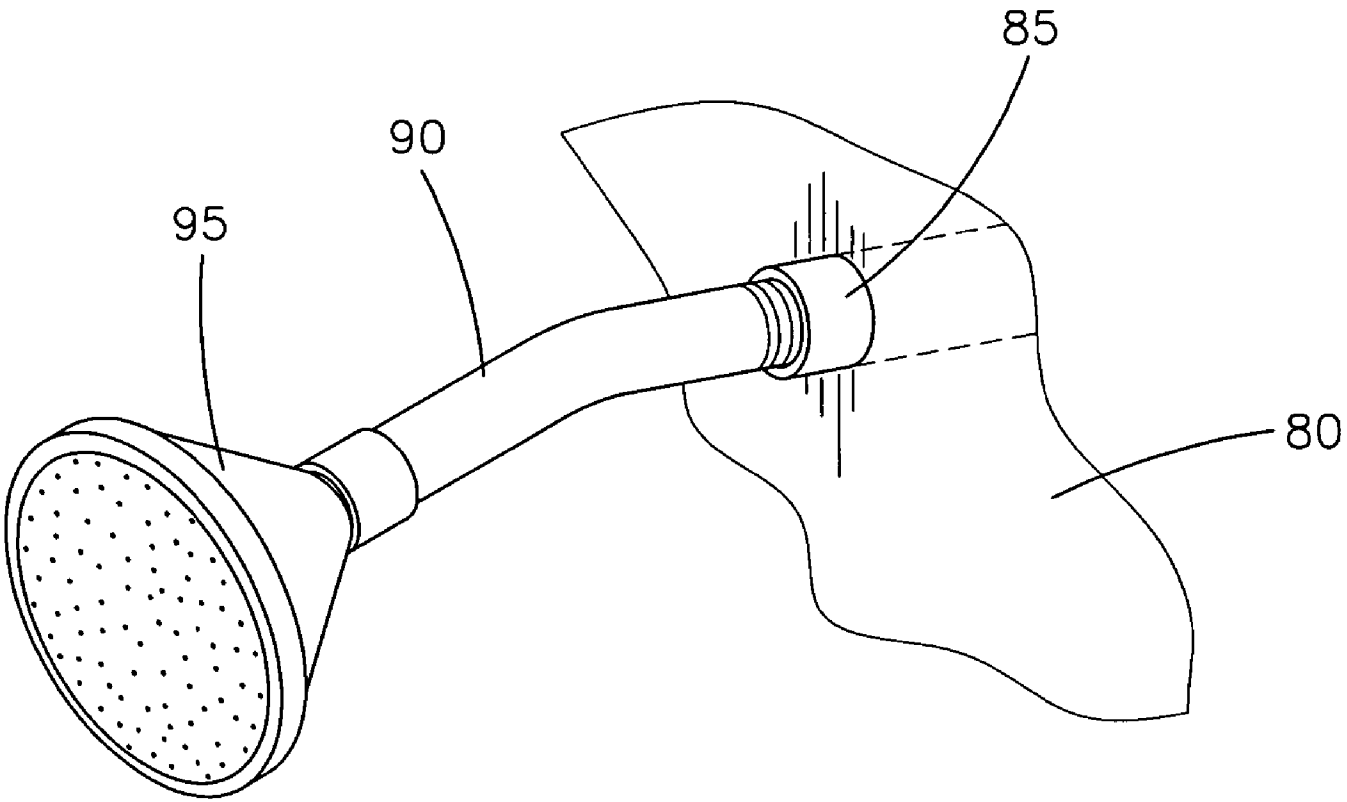
FIG. 10 PRIOR ART
FIG. 10 is a perspective view of a conventional shower head in accordance with the prior art.

Referring to FIGS. 7-9, the filter 50 is mounted in the extension pipe 30 and includes a barrel 51, a filter cartridge 70 mounted in the barrel 51, a first end cap 55 mounted on a first end of the barrel 51 and having a protruding water inlet port 56 connected between an inside of the barrel 51 and the water supply pipe 15, a second end cap 60 mounted on a second end of the barrel 51 II and having a protruding water outlet port 61 having a water outlet hole 62 connected to the inside of the barrel 51, a plurality of water dividing ribs 65 mounted in the second end cap 60 to define a plurality of water dividing channels 66 between the water dividing ribs 65 and the water outlet hole 62 of the water outlet port 61, a first filter net 53 mounted in the barrel 51 and located between the first end cap 55 and the filter cartridge 70, and a second filter net 54 mounted in the barrel 51 and located between the second end cap 60 and the filter cartridge 70.

The water inlet port 56 of the first end cap 55 has an outer wall formed with a plurality of annular grooves 57 for mounting a plurality of sealing members 58 to provide a leakproof effect. The water outlet port 61 of the second end cap 60 has an outer wall formed with a plurality of annular grooves 63 for mounting a plurality of sealing members 64 to provide a leakproof effect. The second end of the barrel 51 has an inner wall formed with a stepped groove 52, and the second end cap 60 has a periphery formed with a stepped flange 67 inserted into the stepped groove 52 of the barrel 51.

When the water from the water supply pipe 15 flows through the water inlet port 56 of the first end cap 55 into the barrel 51, the water is filtered by the filter cartridge 70. Then, the filtered water is divided by the water dividing channels 66 of the second end cap 60 so that the water is injected outward from the water outlet hole 62 of the water outlet port 61 evenly and smoothly, thereby providing a massaging effect to a user.

Accordingly, the locking blocks 31 of the extension pipe 30 are locked in and unlocked from the locking slots 22 of the adapter 20 by rotation of the extension pipe 30, so that the extension pipe 30 is mounted on and detached from the adapter 20 easily and rapidly, thereby facilitating a user mounting and detaching the extension pipe 30 for replacement of the filter cartridge 70. In addition, the cover 40 has an end face rested on the wall 10, thereby enhancing the aesthetic quality of the shower head. Further, the water is divided by the water dividing channels 66 of the second end cap 60 so that the water is injected outward from the water outlet hole 62 of the water outlet port 61 evenly and smoothly, thereby providing a massaging effect to a user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shower head, comprising:

an adapter having an inner peripheral wall formed with a plurality of substantially inverted L-shaped locking slots;

an extension pipe having a first end detachably locked in the adapter and having an outer peripheral wall formed with a plurality of substantially L-shaped locking blocks each detachably locked in a respective one of the locking slots of the adapter by rotation of the extension pipe;

a cover detachably locked on the adapter and rested on the first end of the extension pipe;

wherein the adapter has an outer peripheral wall formed with a plurality of insertion recesses, and the cover has an inner peripheral wall formed with a plurality of insertion blocks detachably inserted into a respective one of the insertion recesses of the adapter.

2. The shower head in accordance with claim 1, wherein each of the locking slots of the adapter has a tapered inner face, and each of the locking blocks of the extension pipe has a tapered inner face urged on the tapered inner face of the respective locking slot of the adapter, so that each of the locking blocks of the extension pipe is closely fitted in the respective locking slot of the adapter.

3. The shower head in accordance with claim 1, wherein the locking slots of the adapter are equidistantly spaced from each other, and the locking blocks of the extension pipe are equidistantly spaced from each other.

4. The shower head in accordance with claim 1, wherein the adapter has a substantially U-shaped cross-sectional profile.

5. The shower head in accordance with claim 1, wherein the extension pipe has a second end provided with a protruding threaded connector for mounting a nozzle.

6. The shower head in accordance with claim 1, wherein the cover has a substantially U-shaped cross-sectional profile.

7. The shower head in accordance with claim 1, wherein the cover has an outer peripheral wall formed with a finger depression to facilitate a user holding the cover.

8. The shower head in accordance with claim 1, wherein the adapter is mounted on a wall, and the cover has a thickness greater than that of the adapter so that the cover has an end face rested on the wall after the first end of the extension pipe is locked in the adapter.

9. The shower head in accordance with claim 1, wherein each of the locking blocks of the extension pipe is locked in or unlocked from a respective one of the locking slots of the adapter by rotation of the extension pipe.

10. A shower head, comprising:

an adapter having an inner peripheral wall formed with a plurality of substantially inverted L-shaped locking slots;

an extension pipe having a first end detachably locked in the adapter and having an outer peripheral wall formed with a plurality of substantially L-shaped locking blocks each detachably locked in a respective one of the locking slots of the adapter by rotation of the extension pipe;

a filter mounted in the extension pipe;

wherein the filter includes a barrel, a filter cartridge mounted in the barrel, a first end cap mounted on a first end of the barrel and having a protruding water inlet port, a second end cap mounted on a second end of the barrel and having a protruding water outlet port having a water outlet hole connected to the inside of the barrel, and a plurality of water dividing ribs mounted in the second end cap to define a plurality of water dividing channels between the water dividing ribs and the water outlet hole of the water outlet port.

11. The shower head in accordance with claim 10, wherein the filter further includes a first filter net mounted in the barrel and located between the first end cap and the filter cartridge, and a second filter net mounted in the barrel and located between the second end cap and the filter cartridge.

12. The shower head in accordance with claim 10, wherein the water inlet port of the first end cap has an outer wall formed with a plurality of annular grooves for mounting a plurality of sealing members to provide a leakproof effect.

13. The shower head in accordance with claim 10, wherein the water outlet port of the second end cap has an outer wall formed with a plurality of annular grooves for mounting a plurality of sealing members to provide a leakproof effect.

14. The shower head in accordance with claim 10, wherein the second end of the barrel has an inner wall formed with a stepped groove, and the second end cap has a periphery formed with a stepped flange inserted into the stepped groove of the barrel.

* * * * *